United States Patent [19]

Tanaka

[11] 3,963,632

[45] June 15, 1976

[54] INSULATING COMPOSITIONS

[75] Inventor: Koji Tanaka, Fuchu, Japan

[73] Assignee: Tokyo Shibaura Denki Kabushiki Kaisha, Japan

[22] Filed: Jan. 7, 1974

[21] Appl. No.: 431,308

Related U.S. Application Data

[63] Continuation of Ser. No. 198,764, Nov. 5, 1971, abandoned, which is a continuation-in-part of Ser. No. 885,175, Dec. 15, 1969, abandoned.

[30] Foreign Application Priority Data

Dec. 17, 1968 Japan ..... 43-92585

[52] U.S. Cl. ..... 252/63.2; 252/63.5; 252/63.7; 174/110 SR; 174/137 A; 174/127; 174/137 B; 174/110 R

[51] Int. Cl.[2] ..... H01B 3/02

[58] Field of Search ..... 252/63.7, 63.5, 64, 252/62.2; 260/2.1 R–2.1 M, 2.2; 117/161 K; 174/110 SR, 110 R, 137, 127

[56] References Cited

UNITED STATES PATENTS

| | | | |
|---|---|---|---|
| 3,499,791 | 3/1970 | Maloney | 117/232 |
| 3,565,833 | 2/1971 | Battaerd | 260/201 |
| 3,632,441 | 1/1972 | Bilow | 117/218 |

*Primary Examiner*—John D. Welsh
*Attorney, Agent, or Firm*—Robert E. Burns; Emmanuel J. Lobato; Bruce L. Adams

[57] ABSTRACT

An insulating coating composition is described which prevents deterioration of the insulating ability of newly fabricated material and when applied will also restore insulation characteristics to material presently in use. The composition comprises a mixture of 1. a main resinous coating of a thermoplastic resin;
2. a cation exchange resin which may be either strongly acidic, i.e., one containing sulfur type, sulphonic acid radicals or weakly acidic, i.e., one containing carboxyl groups or phenolic hydroxyl groups; and
3. an anion exchange resin which may be either strongly basic, i.e., one containing quaternary ammonium radicals or weakly basic, i.e., one containing amine radicals A method of arresting or preventing deterioration of insulating coatings is also disclosed by the use of the above materials which when applied will remove disassociated ions which, in turn, prevent formation of an electroconductive film on the surface of the coating.

10 Claims, 6 Drawing Figures

INSULATING COMPOSITIONS

This is a continuation, of application Ser. No. 198,764, filed Nov. 5, 1971 abandoned, which application is a Continuation-in-part Application of application Ser. No. 885,175 filed Dec. 15, 1969 (now abandoned) and claiming priority of Japanese application 92585/1968 filed Dec. 17, 1968.

BACKGROUND OF THE INVENTION

This invention relates to the art of insulating compositions useful for electric machines and electric apparatus. More particularly, it concerns electric insulating coating compositions capable of preventing degradation of the insulation resistance caused by the environment or atmosphere in which they are used. A means for rapidly recovering decreased insulation resistance is contemplated and will be described hereinbelow.

Insulation resistance of electric machines and apparatus installed in factory areas or areas of contaminated atmosphere or near the seashore decreases gradually during their operation over extended periods of time. This decrease is due to adsorption, deposition thereon or accumulation thereon of gas, vapor mist, dust or moisture or the like, ultimately resulting in large fault such as short circuit and burn out. Such a tendency to decreased resistance is promoted by severe contamination of the atmosphere by sulfurous gas from a concentration of factories and cities in seaside districts. An increase in the transmission voltage and recent trend to compactness of electric machines and apparatus also contributes to the problem.

As mentioned above, degradation of electric insulating materials is also caused by absorption of moisture, but in such a case decrease in insulation resistance is larger in terms of surface resistance than in volume resistance as shown by graphs shown in FIGS. 1 and 2 of the drawing.

In this case, absorption of moisture greatly decreases the surface resistivity of insulating materials and the presence of an electrolyte on the surface of such insulating material rapidly decreases insulation resistance by forming a film of water. Various electrolytes contained in the atmosphere in the form of gas, vapor, mist and dust are thus adsorbed or deposit or accumulate on the surface of the insulating material. For example, a decrease in the insulation resistance caused by salt which occurs frequently in seaside districts, is created by mist or dust containing electrolytes such as sodium chloride and the like in sea water. Furthermore, decrease in the insulation resistance is caused by such water soluble ions as $SO_4^{2-}$, $Cl^-$, $NO_3$, $Mg^{2+}$, K, Na, $Ca^{2+}$, $NH_4^-$, etc., contained in mist or dust in the contaminated atmosphere. Table 1 below shows some typical examples of water soluble ions contained in dust generated by steel manufacturing plants and electric power plants.

Table 1

| Content of Water Soluble Ions in Dust Accumulated | | | |
|---|---|---|---|
| Water soluble ions<br>Location<br>Where dust was sampled | $SO_4^{2-}$ | $Cl^-$ | $NO_3^-$ |
| Steel manufacturing plant A | 11.0% | 3.04% | 0.05% |
| Steel manufacturing plant B | 18.5% | 1.01% | 0.42% |
| Electric power plant | 12.3% | 0.59% | — |

Dusts were collected at ground level and the water-soluble ion content thereof was measured. Principal identified ingredients were aluminum silicate, clay, cement dust and iron oxide. The quantity of the latter was not measured.

Conditions which accelerate a decrease in the insulation resistance and insulation breakdown caused by electrolytes are as follows:

1. Deterioration is particularly accelerated at humidites above the saturated humidity i.e. 75% in the case of NaCl and 81% in the case of $(NH_4)_2 SO_4$ but does not hardly ever occur at a humidity of less than 30%.
2. Deterioration is related to such chemical characteristics as moisture absorptiveness and reactive radicals of the insulation but not always related to electrical characteristics thereof.
3. It varies dependent upon the applied voltage but under definite conditions it is enhanced with increase in the applied voltage.

As described above, although the surface condition of insulators are scarcely affected by electrolytes deposited thereon from the atmosphere of low humidity (less than 30%), as the humidity increases the moisture will deposit or diffuse in the surface of insulators to form molecular films of water. When electrolytes are present in the water film, anions and cations having a degree of freedom corresponding to the transference number of ions will be formed in the water film, thus rendering it conductive so as to decrease the insulation resistance of the insulating material. Further, applied voltage therefore causes transfer of metals due to leakage current, local over voltage, electric discharge, tracking, carbonization and other undesirable phenomena which will result in burn out of the insulation material.

The process of degrading the insulation resistance of the insulating material caused by salt hazard is as follows: Salt components (for example, sodium chloride) deposited on the surface of insulators in the form of mist or dust are dissociated by the water film deposited or absorbed from the atmosphere of high humidity to form electroconductive anions and cations. More particularly:

| electrolyte | under high humidity | ions |
|---|---|---|
| Na Cl | ——— | $Na^+Cl^-$ |
| (nonconductive) | ——— | |
| | under low humidity | (conductive) |

Under the influence of applied voltage these anions and cations migrate toward cathode and anode electrodes, respectively, through an aqueous solution or water film to carry a charge thus effecting electric conduction. In other words, a leakage current results to deteriorate insulating strength.

At the same time, the water also undergoes electrolytic dissociation ($H_2O$ $H^+ + OH^-$). However, as the electrolytic dissociation constant of water is $1.8 \times 10^{-6}$ (at 25°C.) and the resistivity is $6.3 \times 10^8$ ohm-cm (at 25°C.) such dissociation does not affect electric resistance so that it is considered that ions that impart conductivity to the water film are electrolyte compositions contained therein.

In this manner, deterioration of electric insulators is attributable to ions formed by the dissociation of electrolytes contained in moisture deposited or adsorbed in the surface of the insulator.

Accordingly, as a means for preventing deterioration or burning of insulators, the following measures may be used:

1. Decrease the humidity of the atmosphere to less than 30% in order to prevent formation of water films.
2. Use dust proof or totally enclosed construction to prevent deposition of electrolytes.
3. Remove electrolytically dissociated ions to prevent formation of electroconductive films. Measures 1 and 2 are practically used but they are not applicable to all insulating materials or components requiring insulation. On the other hand, surface, treatment to carry out measure 3 is relatively simple and advantageous.

SUMMARY OF THE INVENTION

Accordingly, it is the principal object of this invention to provide insulating coating compositions capable of removing anions and cations formed by the dissociation of electrolytes in water films, and thus preventing deterioration and decreased in electric resistance. The object of this invention is accomplished by providing an insulating coating composition comprising a mixture of a main or base coating component, a cation exchange resin and an anion exchange resin. When desired, other film forming coating material, assistant coating material, pigment and the like may be incorporated into this coating composition.

The main coating material utilized in this invention should therefore permit deionization of the ion exchange resins. Thus: (1) it should be hydrophilic; (2) it should not hinder ion migration and exchange reaction of the ions; (3) it should have good electrical properties; (4) it should have good adhesive property to an insulating substrate, water proofness, moisture proofness, weather proofness and aging proofness; (5) it should be air driable because in most cases it is difficult to heat the insulator coated with the novel insulating coating composition.

Among the basic components of the coating composition having these above described properties are included known resins essentially consisting of organic acid containing hydrophilic radicals (e.g., shellac, rosin, copal); cellulose derivatives containing a number of hydroxyl groups in the molecule (e.g., resinous cellulose acetate, or ethyl cellulose, or nitrocellulose or cellulose acetate-butyrate resins); and highly ion-permeable polar resins (e.g., acrylic resins polyvinyl chloride resin, polyvinyl acetate resin, silicone-alkyd resin, etc.).

In addition to the basic components of the coating composition, among film forming assistant components to be added into the composition, when desired, there are included a drying agent, setting agent, plasticizer, dispersion agent, emulsifying agent and the like. These assistant components are used to improve dispersion of the coating components, drying, setting and other physical characteristics of the applied film. As an additional component, a conventional solvent or diluent may be used to improve the coating ability of the coating composition. Pigment of any color may be used.

The reaction mechanism of removing cations and anions effected by the cation and anion exchange resins is as follows: Taking $Na^+$ and $Cl^-$ as examples of the cation and anion, $$\underbrace{Na^+Cl^- + R{-}H + R'{-}OH}_{\text{Conductive}} \text{ deionizing reaction}$$

$$R{-}Na + R'{-}Cl + \underbrace{H_2O}_{\text{(nonconductive)}}$$

where R—H represents the cation exchange resin and R′—OH the anion exchange resin. R—Na represents the structural formula wherein the cation exchange resin is combined with $Na^+$ ions, whereas R′—Cl the structural formula wherein the anion exchange resin is combined with $Cl^-$ ions.

As can be noted from this equation all electroconductive ions which result in insulation degradation are immobilized by the anion and cation exchange resins in the coating composition so that they cannot migrate. This renders the moisture films non-conductive and the exchange ions are converted into pure water having a resistivity of $6.3 \times 10^8$ ohm—cm thus effectively preventing deterioration of the insulation.

The ion exchange resins generally comprise a hydrocarbon structure of a stable three dimensional network construction to which exchange radicals corresponding to organic acids or organic bases are incorporated. Although such resins contain freely movable ions (that contribute to ion exchange) of the same number as the exchange radicals, such free ions are bound within the resins by the Coulomb force of the exchange radicals.

Among ion exchange resins utilized in this invention are strong electrolyte type resins and weak electrolyte type resins which may be classified as follows:

1. Strong electrolyte type resin
   - Strongly acidic type resin (cation exchange) utilizing sulphur radicals as the exchange radicals.
   - Strongly basic type resin (anion exchange) utilizing quaternary ammonium as the exchange radicals.
2. Weak electrolyte type resin
   - Weakly acidic type resin (cation exchange) utilizing carboxyl groups of phenolic hydroxyl radicals as the exchange radicals.
   - Weakly basic type resin (anion exchange) utilizing primary-, secondary-, and tertiary amines as the exchange radicals.

The coating compositions of this invention undergo above-described deionizing reaction by the reactions of the cation and anion exchange resins incorporated into the compositions whereby to remove cations and anions from the water film thus effectively preventing degradation of the insulating material.

As above described, a suitable pigment may be used for the purpose of improving dispersion of the particles of the ion exchange resin in the coating material. 10 to 50 parts by weight of a pigment may be added.

A powder of an inorganic substance is preferred such as silica, red oxide, mica or alumina.

DESCRIPTION OF THE PREFERRED EMBODIMENTS

The following specific examples are given by way of illustration and are not to be construed as limiting in any way the scope and spirit of the invention.

EXAMPLE 1

This example illustrates one example of the method of preparing the novel coating composition and its function of preventing decrease in the insulation resistance.

The ion exchange resins utilized in this example comprised weak electrolyte type resins as shown in table 2 below.

TABLE 2

| Resin | Weak electroyte resin: Weakly acidic cation exchange resin | Weakly basic anion exchange resin |
|---|---|---|
| Maker | Rohm & Hass Co. Pittsburg, Pa. | Rohm & Hass Co. Pittsburg, Pa. |
| Trade name | AMBERLIGHT CG - 50 | AMBERLIGHT CG - 48 made by means of U.S. Patent No. 2,356,151 |
| Type of Resin | methacrylic acid-divinyl benzene crosslinked copolymer in a 1:1 mol ratio | phenol formaldehyde triethylenetetramine resin |
| Exchange Radical | — COOM radical | amine radical |
| Molecular wt. | 350,000 – 450,000 | 500,000 – 600,000 |
| Type | H - type | OH - type |
| Particle size | 200 – 400 mesh | 200 – 400 mesh |
| Water content | 5 – 10% | 5 – 10% |
| Total exchange ability, mg. equivalent/g. of dry resin | 10.0 | 10.0 |

where M represents metal or hydrogen.

The ion exchange resins shown in Table 2 were incorporated to and kneaded with basic components and assistant components of the coating composition at ratios as shown in Table 3.

TABLE 3

| Coating composition number / Components | Ratio of Components (%) A: A.1 | A: A.2 | B: B.1 | B: B.2 | C: C.1 | C: C.2 |
|---|---|---|---|---|---|---|
| thermoplastic acrylic resin methyl methacrylate viscosity:0.5–4.0 poise a 70°F | 90.0 | 70.0 | — | — | — | — |
| vinyl acetatevinyl chloride copolymer (1:1 ratio | — | — | — | — | 90.0 | 70.0 |
| nitrocellulose resin viscosity:1.0–2.0 poise a 70°F | — | — | 26.9 | 21.0 | — | — |
| alkyd resin (polyester) | — | — | 40.8 | 31.5 | — | — |
| rosin | — | — | 14.2 | 11.1 | — | — |
| plasticizer | — | — | 8.2 | 6.4 | | |
| weakly acidic cation exchange resin (from Table 2) | 5.0 | 15.0 | 5.0 | 15.0 | 5.0 | 15.0 |
| weakly basic anion exchange resin (from Table 2) | 5.0 | 15.0 | 5.0 | 15.0 | 5.0 | 15.0 |
| Total | 100.0 | 100.0 | 100.0 | 100.0 | 100.0 | 100.0 |

The components listed in Table 3 above were dissolved in a solvent consisting of 20% by weight of ethyl acetate, 10% by weight of butyl acetate, 20% by weight of isobutanol, and 50% by weight of toluene. The weight percent of the solvent based on the solid components was 50–80% in the case of lacquer whereas 10 to 30% in the case of the oxidation polymerization type.

Figure 1:
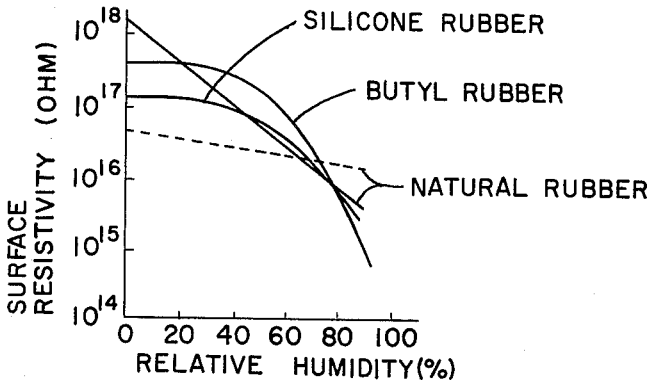
FIG. 1 shows a graph illustrating the effect of relative humidify upon the surface resistivity of electric insulating materials.
Figure 2:
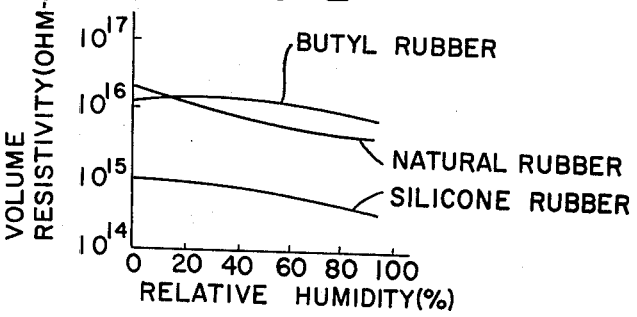
FIG. 2 shows the effect of relative humidity upon the volume resistivity of electric insulating materials.
Figure 3:
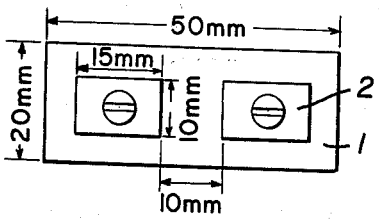
FIGS. 3 and 4 are plane views and sectional views, respectively, of a test piece utilized in example 1.
Figure 4:
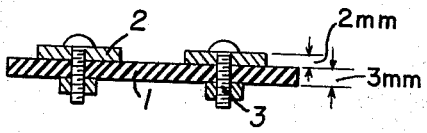

Coating compositions prepared in this manner were applied on insulating plates and their insulation characteristics were tested. The insulating plates were made of phenol resin laminations, and had a configuration and dimensions (50 mm ×20 mm × 3 mm) as shown in FIGS. 3 and 4, wherein reference numeral 1 designated an insulating plate, 2 copper electrodes and 3 screws for fixing the electrodes. Coating compositions were applied by means of spray. After application the coated films were air dried and thereafter copper electrodes 2(15 mm × 10 mm × 2 mm) were attached by screws 3 with a creeping distance of 10 mm therebetween.

Test plates tested in this manner are shown in Table 4.

TABLE 4

| Insulation plates for testing insulating characteristics: Test plate number | Coating treatment |
|---|---|
| 1 | not coated |
| 2 | not coated |
| 3 | Spray coated with sample A.1 in table 3 |

TABLE 4-continued

| Insulation plates for testing insulating characteristics | | | |
|---|---|---|---|
| Test plate number | Coating treatment | | |
| 4 | " | sample A.2 | " |
| 5 | " | sample B.1 | " |
| 6 | " | sample B.2 | " |
| 7 | " | sample C.1 | " |
| 8 | " | sample C.2 | " |

To observe the effect of preventing decrease in the insulation resistance of the novel coating compositions, 10% sodium chloride solution was sprayed on the surface including electrodes of test plates shown in table 4 and the insulation resistance of test plates before and after application of the brine was measured with a megohmmeter under an applied voltage of 500 volts across electrodes, the result of test being shown in table 5.

TABLE 5

| Brine spray time | Test plate | Insulation resistance prior to brine spray | Insulation resistance after brine spray |
|---|---|---|---|
| one minute | 1 | More than 10,000 meg ohms | 700 meg ohms |
| | 2 | " | 630 meg ohms |
| | 3 | " | more than 10,000 meg ohms |
| | 4 | " | " |
| | 5 | " | 5,000 meg ohms |
| | 6 | " | 6,000 meg ohms |
| | 7 | " | 3,000 meg ohms |
| | 8 | " | " |
| three minute | 1 | More than 10,000 meg ohms | 2 meg ohms |
| | 2 | " | 5 meg ohms |
| | 3 | " | 15,000 meg ohms |
| | 4 | " | 2,000 meg ohms |
| | 5 | " | 1,000 meg ohms |
| | 6 | " | 1,000 meg ohms |
| | 7 | " | 400 meg ohms |
| | 8 | " | 500 meg ohms |

As can be clearly noted from Table 5, when compared with not treated plates, insulating plates coated with the novel coating compositions manifests large resistance to the deterioration of insulation caused by brine. Especially, the novel composition containing thermoplastic acrylic resin as the basic component has an insulation resistance of more than 10,000 megohms after being applied with a large quantity of brine whereas insulating plate not coated with the novel composition have decreased their insulating resistance to only several megohms.

In this manner, the novel coating composition has remarkable effect of preventing deterioration of insulating characteristics of insulators.

It is to be understood that the quantity of the cation and anion exchange resins is not limited to that shown in Table 3, although the preferred range is from 0.5 to 35%, by weight, for each ion exchange resin for practical considerations. The following example shows the insulation resistance recovering effect of the novel coating composition also when added to deteriorated surfaces.

EXAMPLE 2.

To confirm the insulation resistance recovering effect of the novel coating composition, terminal posts whose insulation resistance has actually been decreased were selected.

Ion exchange resins utilized in this example were the same weak electroyte type resins which were used in Example 1 and shown in Table 2 above. These ion exchange resins were mixed with basic and assistant components of the coating composition according to the formulation shown in Table 6.

TABLE 6

| Ratio of Components (%) | | |
|---|---|---|
| Components | Coating Composition D | E |
| cellulose triacetate resin viscosity 1.0 to 2.0 poise a 70°C | 60 | — |
| thermoplastic acrylic resin (methyl methacrylate) viscosity 0.5 to 4.0 poise a 70°F | — | 60.0 |
| rosin | 10.0 | 10.0 |
| weakly acidic ion exchange resin (as in Table 2 above) | 15.0 | 15.0 |
| weakly basic ion exchange resin (as in Table 2 above) | 15.0 | 15.0 |
| Total | 100.0 | 100.0 |

These components were dissolved in a solvent consisting of 20% by weight of a mixture of ethyl acetate and butyl acetate, 5% by weight of butanol, 65% by weight of toluene, 5% by weight of ketone and 5% by weight of ethylcellosolve, the ratio of solvent to the solid component being the same as in Example 1. Terminal posts tested comprised moulded insulator plates having silver plated copper plate terminal embedded therein and had been used in a substation for 7 years.

Figure 5:
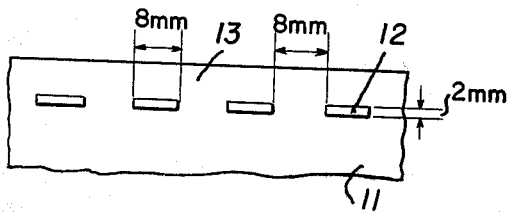
FIGS. 5 and 6 are plane view and elevation, partly in section, respectively, of a test terminal post utilized in example 2.
Figure 6:
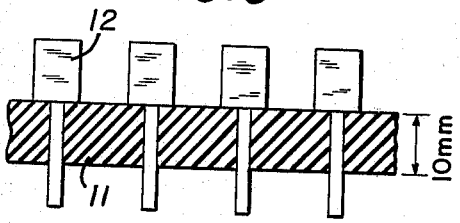

Due to their use for 7 years the surface of the terminal posts was considerably contaminated with dust and other foreign substances. Insulation resistance between terminals of heavily contaminated terminal posts was 50 to 500 megohms as compared with more than 10,000 megohms of not contaminated terminal posts. Terminal posts tested had a configuration and dimensions as shown in FIGS. 5 and 6, wherein numeral 11 designates an insulating plate, 12 silver plated copper terminals and 13 contaminated regions.

Terminal posts which had been heavily contaminated such that the insulation resistance between terminals had decreased to less than 500 megohms were selected and coating composition shown in Table 6 were applied by means of a brush onto such contaminated regions between terminals.

Recovery of the insulation strength effected by the novel coating composition is shown in Table 7.

TABLE 7

| Recovery of the insulation resistance | | | | | |
|---|---|---|---|---|---|
| | | Coating treatment | insulation resistance prior to coating | insulation immediately after coating | resistance after one hour | after four days |
| Temperature at time of measurement | | — | 22.0°C | 22.0°C | 21.5°C | 17.5°C |
| Humidity at time of measurement | | — | 70% | 70% | 70% | 70% |
| Terminal posts tested | 1 | Coating comp.D of table 6 was applied by brush | 170 meg ohms | 150 meg ohms | 1400 meg ohms | 6000 meg ohms |
| | 2 | Coating comp.E of table 6 was applied by brush | 300 meg ohms | 250 meg ohms | 1500 meg ohms | 5000 meg ohms |

This table shows that the novel composition has the effect of greatly recovering the insulation resistance.

As a control, a terminal post having decreased insulation resistance of 400 megohms was selected and the variation of its insulation resistance was measured under the same temperature and humidity conditions. It was found that the insulation resistance has decreased to 200 megohms, after 4 days.

EXAMPLE 3

This example shows the results of tests made on the decrease in insulation resistance. The insulating substrate used was a phenol resin laminated board having dimensions of 100 × 155 × 2 mm. Sample A was not treated with any coating composition, sample B was coated with a silicone alkyd varnish and sample C with a novel coating composition consisting of 35 parts, by weight, of a silicone modified alkyd varnish, 50 parts, by weight, of a 1:1 mixture of CG-50 and CG-4B (see Table 2) and 15 parts, by weight, of red oxide. In both samples A and B the coating compositions were sprayed onto the substrates and dried at room temperature to a dry thickness of about 20 microns. A sludge-like composition consisting of, 80 parts by weight of diatomaceous earth (used as a model dust) and 20 parts, by weight, of sodium chloride (NaCl) suspended in 100 parts of ethanol was uniformly sprayed onto the surface of each sample. The quantity of the NaCl containing dust coated on the samples was 1.2 mg/cm$^2$ of which 0.24 mg/cm$^2$ was NaCl.

Deterioration of the insulating strength of respective samples was measured at a temperature of 20°–30°C, and under a relative humidity of 80%. The results of measurements are shown in the following Table 8.

Table 8 shows that the insulation resistance of control samples A and B deteriorated more rapidly than that of sample C.

TABLE 8

| Sample | Measuring conditions electrode spacing Ωm. | Before applying the dust 20°C 60%RH | After applying the dust 22°C 55%RH | 80%RH after 2 days | 80%RH after 5 days | 80%RH after 10 days | 80%RH after 22 days | 80%RH after 36 days |
|---|---|---|---|---|---|---|---|---|
| | | Variation in the Insulation Resistance in Megohms for the NaCl Containing Dust | | | | | | |
| A | 5 | 9.6×10$^4$ | 70 | 2.3 | 2.7 | 1.1 | 2.2 | 0.088 |
| | 10 | 1.0×10$^5$ | 76 | 2.7 | 3.0 | 5.7 | 1.6 | 0.085 |
| | 20 | 7.9×10$^4$ | 48 | 2.2 | 1.8 | 4.0 | 1.4 | 0.10 |
| | 40 | 1.0×10$^5$ | 91 | 5.3 | 4.2 | 8.0 | 2.1 | 0.30 |
| B | 5 | 3.6×10$^5$ | 490 | 1.5 | 2.6 | 0.93 | 0.37 | 0.036 |
| | 10 | 1.2×10$^6$ | 470 | 9.1 | 3.9 | 2.6 | 0.12 | 0.030 |
| | 20 | 1.2×10$^6$ | 710 | 13 | 6.3 | 4.5 | 0.60 | 0.017 |
| | 40 | 1.2×10$^6$ | 1,800 | 21 | 14 | 12 | 1.4 | 0.022 |
| C | 5 | 2.0×10$^5$ | 1.9× 10$^4$ | 1,200 | 490 | 790 | 160 | 370 |
| | 10 | 2.4×10$^5$ | 2.4×10$^4$ | 1,700 | 710 | 990 | 130 | 330 |
| | 20 | 2.8×10$^5$ | 1.3×10$^4$ | 910 | 240 | 240 | 81 | 240 |
| | 40 | 3.9×10$^5$ | 1.9×10$^4$ | 1,000 | 430 | 720 | 720 | 340 |

EXAMPLE 4

This example shows the anti-tracking property of the novel coating composition. The anti-tracking property was measured by the method specified in "IEC publication 112" wherein a pair of electrodes are placed on the substrate with a spacing of 4 mm therebetween. While applying a constant voltage across the electrodes, a 0.1% solution of ammonium chloride was applied, drop after drop, at a rate of two drops per minute, and such dropwise application is continued until the insulator substrate burns. In Table 9, the number of drops until burning occurs at an applied voltage of 400 volts (AC) is indicated.

Table 9

| Samples tested: Substrate | Samples tested: Surface Treatment | Number of drops of 0.1% $NH_4Cl$ until burn out under applied voltage of 400 V. |
|---|---|---|
| Phenolic resin laminate | Not treated | 3 |
| " | Treated with silicone alkyd varnish | 4 |
| Polyester glass | Not treated | 10 |
| Phenolic resin laminate | Treated with novel coating compositions according to this invention | 35 |

What is claimed is:

1. An electrical insulating coating composition of improved surface insulating qualities in the presence of moisture and ionizible salts comprising an electrically insulating resinous matrix component having incorporated therein both a cationic ion-exchanger component and an anionic ion-exchange component wherein each of said anionic exchanger component and said cationic exchanger component is incorporated in said coating composition in the amount of from 5.0 to 35% based on the total weight of said coating composition.

2. The coating composition according to claim 1 wherein said cationic ionexchange component is selected from the group consisting of a strongly acidic type resin containing sulphonic acid radicals or weakly acidic type resins containing either one or more carboxyl groups or one or more phenolic hydroxyl groups.

3. The coating composition according to claim 1 wherein said anionic exchange resin component is selected from the group consisting of a strongly basis type resin containing quaternary ammonium radicals and a weakly basic type resin containing amine radicals.

4. An insulating coating composition according to claim 1, wherein said thermoplastic resin selected from the group consisting of acrylic resins, resinous vinyl acetate, vinyl chloride and its copolymer, substituted cellulosic resins, or rosins.

5. An insulating coating composition according to claim 1 in which said matrix component is a thermosetting resin.

6. An insulating coating composition according to claim 7 in which said thermosetting resin is an alkyd resin.

7. A method of restoring the surface insulating qualities of contaminated electrical insulators which comprises applying to the exposed surfaces of said insulator a liquid film of the composition according to claim 1 via a solution or suspension of said coating composition in a solvent vehicle and then removing said vehicle and leaving a coating of said composition.

8. A method for manufacturing electrical equipment having high dielectric strength which comprises coating the insulating composition according to claim 1 upon the surfaces of the equipment to be insulated.

9. A method of providing electrical insulation to electrical conductors which comprises the steps of coating said conductors with the composition according to claim 1 in a solvent vehicle and removing said vehicle to provide the insulating conductor coated with the composition according to claim 1.

10. A method of applying electrical insulation between conducting metal parts at different electrical potentials which comprises coating surfaces separating said parts at different potentials with compositions according to claim 1.

* * * * *